United States Patent [19]

Anderson

[11] 4,422,701

[45] Dec. 27, 1983

[54] ELECTRICAL RECEPTACLES

[76] Inventor: Raymond G. Anderson, 206 N. Sharmin St., Ankeny, Iowa 50021

[21] Appl. No.: 410,650

[22] Filed: Aug. 23, 1982

Related U.S. Application Data

[63] Continuation of Ser. No. 157,562, Jun. 9, 1980, abandoned.

[51] Int. Cl.[3] ..... H01R 3/04

[52] U.S. Cl. ..... 339/14 R; 339/95 D

[58] Field of Search ..... 339/14 R, 95 D

[56] References Cited

U.S. PATENT DOCUMENTS 3,713,071 1/1973 Poliak et al. ..... 339/14 R 3,900,238 8/1975 Anderson ..... 339/14 R

*Primary Examiner*—Joseph H. McGlynn

*Attorney, Agent, or Firm*—Zarley, McKee, Thomte, Voorhees & Sease

[57] ABSTRACT

An outlet plug receptacle having a quick-wiring, stab-in, ground terminal arranged to receive a ground wire and grip the same, with the ground terminal being formed at least in part from the outlet plug mounting strap. Also disclosed is a snap-in, quick connect wire holder which may be easily and quickly snapped into place in an electrical box for releasable receipt in the wire connect aperture of the electrical box to hold electrical wires.

5 Claims, 6 Drawing Figures

ELECTRICAL RECEPTACLES

This is a continuation of application Ser. No. 157,562 filed June 9, 1980, now abandoned.

BACKGROUND OF THE INVENTION

With respect to the present invention, it relates in part to an improvement over my invention of U.S. Pat. No. 3,900,238 which issued Aug. 19, 1975. In my previous patent, the invention related generally to a quick wiring, stab-in ground terminal for an electrical outlet plug receptacle. The present invention with respect to the outlet plug receptacle embodiment represents an improvement over the device of my prior patent.

In the prior structure, the stab-in connector was comprised of separate and distinct pieces over and above the conventional pieces forming an electrical receptacle. Thus, while this device worked fine, it did necessitate that manufacturers who chose to proceed with a push-in, ground gripping terminal, had to increase manufacturing costs. This increased manufacturing cost was necessitated by the additional pieces needed in forming the ground wire, stab-in terminal.

Therefore, a principal object of the present invention is to achieve the advantages of my prior structure with a plug-in receptacle which allows forming of the ground terminal stab-in as a part of the conventional pieces of such an electrical receptacle.

Yet another object of this invention is to achieve an electrical receptacle which employs a quick wiring, stab-in ground terminal which is formed in part by the electrical plug mounting strap.

An even further object of this invention is to provide a duplex plug receptacle which has a quick wiring stab-in ground terminal which is formed in part by the plug mounting strap and which has a tool access aperture for insertion of a tool to deflect the wire gripper to allow release of a gripped wire quickly and easily.

A further object of this invention is to provide a snap-in, quick connect wire holder which may be conveniently snapped into the wire receiving aperture of an electrical box. Using a snap-in connector in combination with an electrical box allows for quick and easy insertion of power wires into an electrical box. This avoids the time consuming process used with the prior art wire connectors which often employ a device which is inserted through the electrical box aperture which is threaded and thereafter a lock nut is threaded on the back side. Such a process is extremely time consuming. The quick snap-in connector is much easier to install. It is also easier and quicker to remove, if removal is necessary.

It can therefore be seen that the primary objects of the present invention are to provide two quick connect devices, both of which can be used by electricians to save considerable amounts of time.

Also, the object of this invention is to provide these devices in a structural form which is economical, easy to manufacture, and easy for use. In particular, it is a primary object of this invention to provide two devices to aid electricians in wiring, which are low in cost for manufacture so that the receptacles may be manufactured and used for their convenience in wiring without any significant accompanying cost increase.

Finally, with respect to the electrical plug receptacle, it is yet another object of the invention to provide a push-in ground terminal, which not only forms a part of the plug mounting strap, but which is positioned at a location on the device such that it does not interfere with the electrical spacings between the line and the neutral contacts of the plug receptacle.

The manner of achieving each of these objects will become apparent from the detailed description of the invention which follows hereinafter.

SUMMARY OF THE INVENTION

Two devices for use by an electrician, both of which are an aid allowing quicker and more convenient wiring, are described. The first is a duplex plug receptacle which has a quick wiring, stab-in ground terminal formed at least in part from the plug mounting strap in order to reduce cost. Additionally, the quick wiring, stab-in ground terminal is located in a position on the plug receptacle which prevents interference with electrical spacings between the line and neutral contacts. With respect to the second device, it is a snap-in, quick connect wire holder to be used with an electrical box. It eliminates the time consuming process of placing wire connect holders in position with respect to electrical boxes.

DETAILED DESCRIPTION OF THE INVENTION

Figure 1:
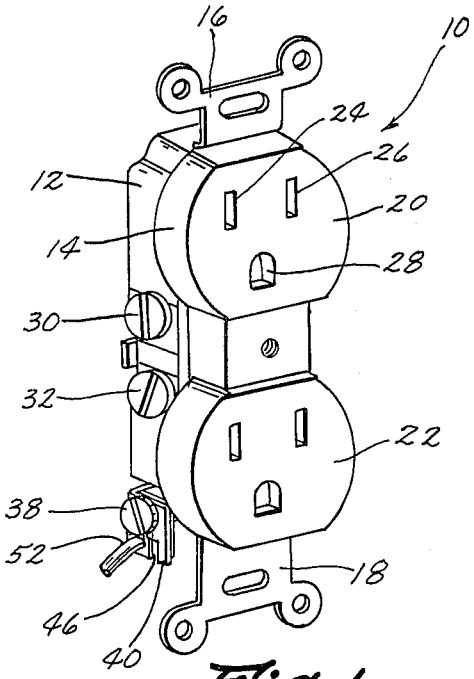
FIG. 1 is a perspective view of the duplex plug receptacle of the invention.
Figure 5:
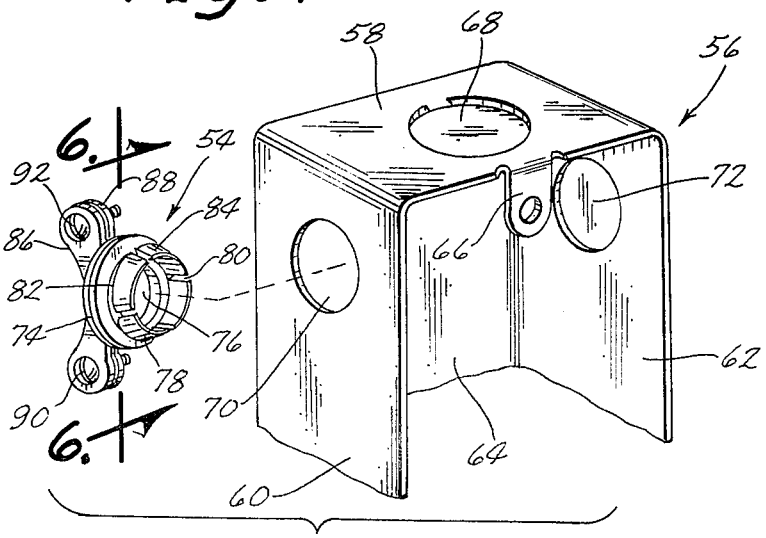
FIG. 5 is an elevated, exploded perspective showing the quick wiring, stab-in connector of the invention.

Referring now to FIG. 1, there is shown a duplex receptacle 10 comprising the usual housing 12 and a cover member 14 which have mounted between them mounting straps 16 and 18. Mounting straps 16 and 18 are employed as the means by which the receptacle is fixed in the usual outlet box, a portion of which is depicted in FIG. 5.

The duplex receptacle 10, and in particular the cover member 14, has the usual form and provides two plug receiving units 20 and 22, each of which has prong receiving apertures 24, 26 and 28.

Electrical connecting screws 30 and 32 are of conventional construction and are employed to connect power terminal wires in the usual fashion. For purposes of clarity of description hereinafter, mounting strap 16 will be referred to as the top strap, and mounting strap 18 will be referred to as the bottom mounting strap.

Figure 2:
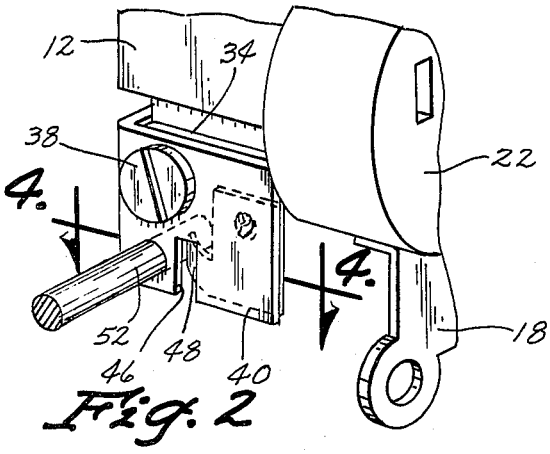
FIG. 2 is an elevated perspective view of the quick wiring, stab-in ground terminal.
Figure 3:
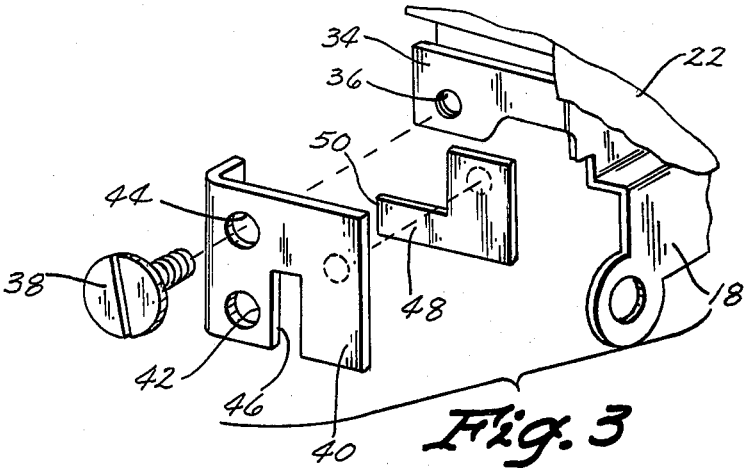
FIG. 3 is an exploded fragmentary view of the component pieces of the quick wiring, stab-in ground terminal.

Top mounting strap 16 is conventional in every respect. However, as can be seen in FIGS. 1, 2 and 3, and particularly in FIG. 3, the bottom mounting strap is different in its construction. In particular, bottom mounting strap 18 has a rearwardly extending mounting leg 34, which extends rearwardly from bottom mounting strap 18 adjacent to the side (not numbered) of insulated housing 12 near its bottom. Leg 34 has an aperture 36, as best depicted in FIG. 3, for receipt of fastening bolt 38.

The quick wiring, stab-in ground terminal is comprised of the leg portion 34 of bottom mounting strap 18 and two other component parts. The first of these component parts is a cover portion 40 which has a ground wire receiving aperture 42 and a bolt receiving aperture 44, as well as a longitudinal tool access aperture 46. On the rear face or side of cover portion and/or cover plate 40, the two terms being used interchangeably herein, is a deflectable arm 48. Deflectable arm 48 is attached via riveting or other suitable means, to the rear side of cover plate 40 in a position such that its wire gripping edge 50 partially obstructs the ground wire receiving aperture 42.

Figure 4:
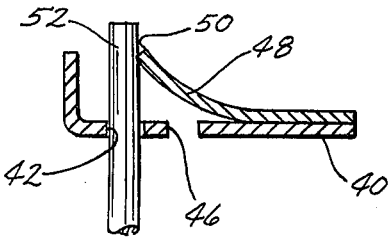
FIG. 4 is a sectional view along line 4—4 of FIG. 2.

The operation of the quick wire stab-in ground terminal is illustrated best in FIG. 4. A ground wire 52 is inserted through aperture 42 and since aperture 42 is partially obstructed by gripping edge 50 of deflecting arm 48, ground wire 52 deflects arm 48 as depicted in FIG. 4. The gripping edge 50 of deflectable arm 48 grips ground wire 52 and prevents its removal. If during the course of wiring, one desires to remove ground wire 52, a tool, such as a screw driver, is inserted through tool access aperture 46 and pushed against deflectable arm 50. This releases the wire gripping edge 50 and the ground wire 52 may be removed.

It therefore can be seen that the primary advantage of my present structure over my previously patented structure is that the quick wiring, stab-in ground terminal is formed in part as an integral portion of the bottom mounting strap of the duplex receptacle. Also, the quick wiring stab-in of the present invention is of simpler construction than that of my prior patent. In addition, the quick wiring stab-in ground terminal of the present dual plug receptacle is located with respect to the other components of the receptacle such that it will not interfere in any respect with the electrical spacing for the power lines.

It should be understood that the duplex plug-in receptacle is shown as illustrative and that other electrical receptacles such as switches may also employ the ground wire stab-in improvement of this invention.

Figure 6:
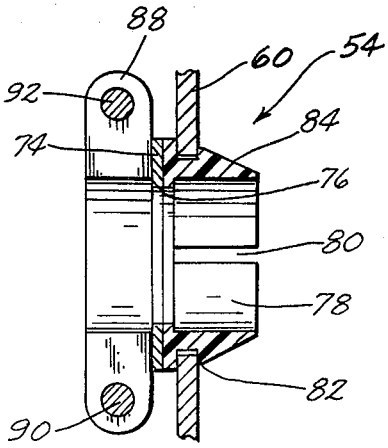
FIG. 6 is a sectional view along line 6—6 of FIG. 5 showing the cross-section through the quick connect wire holder.

Turning now to a description of the structure shown in FIGS. 5 and 6, there is shown a snap-in, quick connect wire holder generally depicted at 54. The quick connect wire holder 54 is intended to be used with a conventional electrical box 56. The electrical box 56 is comprised of a top wall 58, a bottom wall (not shown), two spaced apart side walls 60 and 62 and a rear wall 64. The front face of the electrical box is open. Conventional lugs 66 are used to attach the electrical box 56 to an electrical receptacle. Also, in the usual manner, the wall portions of the electrical box 56 have a series of spaced apart break-away slugs 68. The electrician breaks away slugs 68 to provide wire receiving or connecting apertures as depicted at 70 and 72.

The snap-in wire holder 54 is comprised of a top ring member 74 having a central aperture 76. Projecting at generally a right angle from the longitudinal axis of ring member 74 is a flexible snap-in, tapered extension rim 78. Rim 78 has a plurality of spaced apart slots 80. Ring member 74 and rim 78 are made of a flexible and/or squeezable material. As a result, when rim 78 is inserted into aperture 70, the rim is squeezed and flexes inwardly so that rim 74 will fit through aperture 70. The squeezing is enhanced because of the longitudinal rim slots 80. Extending circumferentially around rim 80 is ridge 82. Rim ridge 82 snaps through aperture 70 because of the flexible material, slots 80, and the taper depicted at 84 of rim 78. Once rim ridge 82 snaps through aperture 70, the rim 78 expands and ridge 80 locks the connector in position in wire connecting aperture 70.

Attached to the back or top of ring member 74, are wire grippers 86 and 88 which may be tightened against each other via fasteners 90 and 92 to firmly grip power wire.

Thus, as can be seen the snap-in connector 54 may be inserted through aperture 70 which squeezes extension rim 78 inwardly, but once ridge 80 passes through aperture 70, the flexible rim 78 flexes outwardly and rim 80 engages the interior surface of side wall 60. One or more wires may then be inserted through central ring aperture 76 and wire grippers 86 and 88 tightened via fasteners 90 and 92. To remove the quick connect apparatus, the process is simply reversed. Grippers 86 and 88 are opened, the wires are removed, one may then manually grab grippers 86. 88 and pull away from aperture 70. This causes flexible rim 78 to be squeezed inwardly because of the applied pressure, and eventually ridge 82 is squeezed sufficiently to be pulled through aperture 70 and the quick connect wire gripper removed.

It therefore can be seen that an extremely efficient snap-in, quick connector wire holder is provided. One need not engage in the time-consuming process of threadably attaching the holder to the electrical box.

Suitable flexible materials from which the quick connect holder ring and extension rim may be made, include conventional plastic materials such as polypropylene, polyethylene, polyvinyl chloride and others. The precise material is not critical, as long as it has some flex.

What is claimed is:

1. An outlet plug receptacle comprising, an insulated housing having wall portions forming a chamber for holding power terminals and a ground terminal therewithin, an electrical cover means for said housing having at least one plug receiver, at least one plug mounting strap positioned between said housing and said cover to fix said receptacle to an outlet box, at least two power wire terminals mounted within said housing chamber, a ground terminal having a threaded aperture in said mounting strap and a mated threaded screw for securing a ground wire by turning said screw down upon said ground wire, and a quick wiring, stab-in, ground terminal arranged to receive a ground wire and grip the same, said ground terminal being formed at least in part as an integral portion of said plug mounting strap and being removably secured to said mounting strap by said ground terminal screw.

2. The device of claim 1 wherein said plug mounting strap has a rearwardly extending mounting leg which forms a part of said quick wiring, stab-in, ground terminal.

3. The device of claim 2 wherein said quick wiring, stab-in, ground terminal comprises a cover portion having a ground wire receiving aperture, fastening means joining said cover to said rearwardly extending mounting leg, said cover portion having a front face and a rear face, and attached to said rear face a deflectable arm with a ground wire gripping edge which partially obstructs said ground wire receiving aperture.

4. The device of claim 3 wherein said cover portion also has a tool access aperture aligned with said deflectable arm for insertion of a tool to deflect said arm to release a gripped wire.

5. The device of claim 3 wherein said mounting leg is positioned away from said power wire terminals to prevent interference with the power wires and power terminals while attaching and disattaching said ground wire.

* * * * *